US006273105B1

(12) United States Patent
Jones

(10) Patent No.: US 6,273,105 B1
(45) **Date of Patent: *Aug. 14, 2001**

(54) METHOD AND APPARATUS FOR CLEANING THIN SUBSTRATES

(75) Inventor: Jeffrey D. Jones, Corona, CA (US)

(73) Assignees: Eamon P. McDonald, Canyon Lake; Seamus P. McDonald, Temecula, both of CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 08/992,050

(22) Filed: Dec. 17, 1997

Related U.S. Application Data

(63) Continuation of application No. 08/342,132, filed on Nov. 18, 1994, now Pat. No. 5,746,234.

(51) Int. Cl.[7] ..... B08B 3/04

(52) U.S. Cl. ..... 134/64 R; 134/78; 134/122 R; 134/73; 198/780

(58) Field of Search ..... 134/64 R, 78, 134/122 R, 73, 199, 114, 66, 61; 198/780, 785, 37; 118/424

(56) References Cited

U.S. PATENT DOCUMENTS

| | | |
|---|---|---|
| 4,043,786 | 8/1977 | Myers . |
| 4,074,995 | 2/1978 | Frank . |
| 4,270,317 | 6/1981 | Kurie . |
| 4,458,703 | 7/1984 | Inoue et al. . |
| 4,475,259 | 10/1984 | Ishii et al. . |
| 4,722,355 | 2/1988 | Moe et al. . |
| 4,811,443 | 3/1989 | Nishizawa . |
| 5,005,250 | 4/1991 | Trautmann et al. . |
| 5,038,706 | 8/1991 | Morris . |
| 5,063,951 | 11/1991 | Bard et al. . |
| 5,083,364 | 1/1992 | Olbrich et al. . |
| 5,118,357 | 6/1992 | Sabatka . |
| 5,191,908 | 3/1993 | Hiroe et al. . |
| 5,209,180 | 5/1993 | Shoda et al. . |
| 5,209,782 | 5/1993 | Morris . |
| 5,282,485 | 2/1994 | Harai et al. . |
| 5,289,639 | 3/1994 | Bard et al. . |
| 5,291,665 | 3/1994 | Yoshikawa . |
| 5,294,259 | 3/1994 | Canestarno et al. . |
| 5,472,080 | 12/1995 | Fukuoka . |

FOREIGN PATENT DOCUMENTS

| | | |
|---|---|---|
| 234134 | 11/1963 | (AT) . |
| 0 174 294 B1 | 2/1985 | (DE) . |
| 61-37312 | 2/1986 | (JP) . |
| 62-136428 | 6/1987 | (JP) . |
| 63-154504 | 6/1988 | (JP) . |
| 64-9956 | 2/1994 | (JP) . |

*Primary Examiner*—Frankie L. Stinson
(74) *Attorney, Agent, or Firm*—Akin, Gump, Strauss, Hauer & Feld, L.L.P.

(57) ABSTRACT

A method and apparatus are provided for the fine cleaning of a thin substrate. The apparatus has a transporter capable of moving the substrate through the apparatus by non-fluid contact with the edges of the substrate alone. In a typical embodiment, the transporter is a series of centrally-tapered rollers. As the substrate is moved through the apparatus by the transporter, its central section is supported by a fluid. Thus, the substrate moves through the apparatus without contact with any solid material except on its edges. As the substrate is moved through the apparatus by the transporter, fluid ejectors wash the substrate by spraying a cleaning fluid against the substrate. After being washed, the substrate is rinsed and then dried. Anti-dragout devices are positioned upstream and downstream of the washing and rinsing sections so as to minimize liquid dragout. The invention has been found very effective in cleaning thin sensitive substrates wherein physical contact with solid devices tends to contaminate the surface. The invention thoroughly cleans such thin substrates with little or no contamination. The invention has been shown to be effective at high throughputs.

6 Claims, 10 Drawing Sheets

28
69
82
80
14
2

METHOD AND APPARATUS FOR CLEANING THIN SUBSTRATES

CROSS-REFERENCE TO RELATED APPLICATIONS

This application is a continuation of U.S. application Ser. No. 08/342,132, filed on Nov. 18, 1994, now U.S. Pat. No. 5,746,234.

FIELD OF THE INVENTION

This invention relates to methods and apparatus for cleaning thin, sensitive substrates such as glass plates used for liquid crystal displays and solar panels.

BACKGROUND

In the art of processing articles sensitive to contamination, such as glass plates for Liquid Crystal Displays (LCD's), solar panels, etc. (hereinafter referred to as "substrates"), it is desirable to have a process that has both an efficient cleaning capability and high throughput rate.

The present art includes primarily conveyorized processing and batch processing apparatuses. Conveyorized processing has the advantage of continuous processing and a potentially high throughput rate. Present systems convey the substrate with the substrate in horizontal and/or vertical orientations. The present art includes systems with brushes or other mechanical scrubbing devices which are used to remove undesired stains and particulates from the substrate surface. Because of the forces exerted by these scrubbing devices, grippers that contact an undesirable amount of substrate surface area are employed to hold and/or convey the substrate. This contact can leave microscopic particulates on the substrate surface, which are undesirable. Also, mechanical contact is employed to remove liquid from the surface of the substrate to reduce the amount of liquid carried on the substrate to previous or subsequent processes, a phenomenon known as "dragout." Dragout is undesirable from both the standpoint of cleaning efficiency and chemical waste treatment efficiency. In the cases where a gaseous barrier is used in place of mechanical contact, the consequence of drying the liquid prematurely on the substrate surface and depositing undesirable residues can result. Mechanical contact is also employed on the bottom surface of horizontally conveyed substrates to support the substrate from sagging or by a clamp or wheels or cylinders for vertically conveying substrates, both of which can leave unwanted microscopic debris on the substrate surfaces. As a result of these disadvantages, substrates processed with conveyorized equipment are typically only used for applications with relatively relaxed cleanliness requirements (such as glass for twisted-pneumatic(TN) LCD's), or significant portions of the substrate are not used, such as areas where wheels or clamps come into contact with the substrate.

Batch processing can overcome many of the disadvantages above regarding cleaning efficiency. For example, carrier racks or baskets can be constructed which contact the substrates primarily on the edges along the perimeter of the substrate rather than on the surfaces. In dip-tank processing, multiple immersion processes are used to treat, clean, rinse and dry the substrate. The carrier rack or basket is placed vertically into and from each process tank. The disadvantages of using this type of method are both the additional handling needed to load and unload the substrate from the carrier and also the relatively long length of time the basket or rack must be drained after each step to minimize dragout. Additionally, carriers or racks must be adjusted or re-fabricated for processing substrates of different sizes. Other batch processors sequentially perform several steps in one chamber, such as scrubbing, rinsing and drying, and as a result are relatively low in throughput. Overall, the batch-type processors typically perform with lower throughput than would be desired and/or require additional handling steps, both of which increase the cost of processing the substrates.

Therefore, there is a need for a relatively simple and cost effective method and apparatus for cleaning thin, sensitive substrates which has a high throughput rate which does not impart microscopic debris on the substrate surface and which allows minimum dragout.

SUMMARY

The invention is an apparatus and a method for using the apparatus for the fine cleaning of a thin substrate. The apparatus comprises a transporter having one or more edge contactors which move the substrate along a transport path at a uniform transport velocity by non-fluid contact with the edges of the substrate alone. One or more washing delivery fluid ejectors is disposed along the transport path for delivering washing fluids to substrates transported along the transport path. One or more supporting fluid delivery ejectors capable of delivering a supporting fluid to a substrate transported along the transport path is also provided.

In a preferred embodiment, the transporter can comprise a plurality of centrally-tapered rollers which contact the substrate along the substrate edges only. Alternatively, the transporter can comprise a plurality of movable wheels or one or more conveying belts.

Typically, the washing fluid ejectors are jet nozzles which emit a liquid washing fluid. Alternatively, spray nozzles can be used.

Typically, the support fluid is a clean gaseous material. Alternatively, liquids can be used. In one embodiment, the washing fluid and the support fluid are one and the same.

In a preferred embodiment, the invention further comprises an anti-dragout device disposed after the washing fluid ejectors along the transport path. The anti-dragout device comprises a plurality of anti-dragout ejectors disposed at an angle between about 10° and about 80° with respect to the transport path. The anti-dragout ejectors are capable of delivering a countercurrent fluid stream to the transport path such that liquid flowing past the anti-dragout ejectors is less than about 10 milliliters per square foot of substrate surface.

In another preferred embodiment, the invention further comprises a drying device comprising a first row of fluid ejectors disposed transverse to the transport path. Each fluid ejector is inclined with respect to the transport path at an angle of between about 0° and about 45°. The ratio of the center-to-center spacing to the average diameter of the fluid ejectors is between about 1.25 and about 5.

With the present invention, contact on the surface of substrates is minimized while cleaning or treating, rinsing and drying the substrate, and liquid dragout is minimized without long drain times or mechanical or gaseous contact. An efficient fluid-delivery system replaces mechanical scrubbing for debris and film removal. As a result, substrates can be processed both with efficient cleaning capability and a relatively high rate of throughput.

DESCRIPTION OF THE DRAWINGS

These and other features, aspects and advantages of the present invention will become better understood with reference to the following description, appended claims and accompanying drawings where:

DETAILED DESCRIPTION OF THE INVENTION

Figure 1:
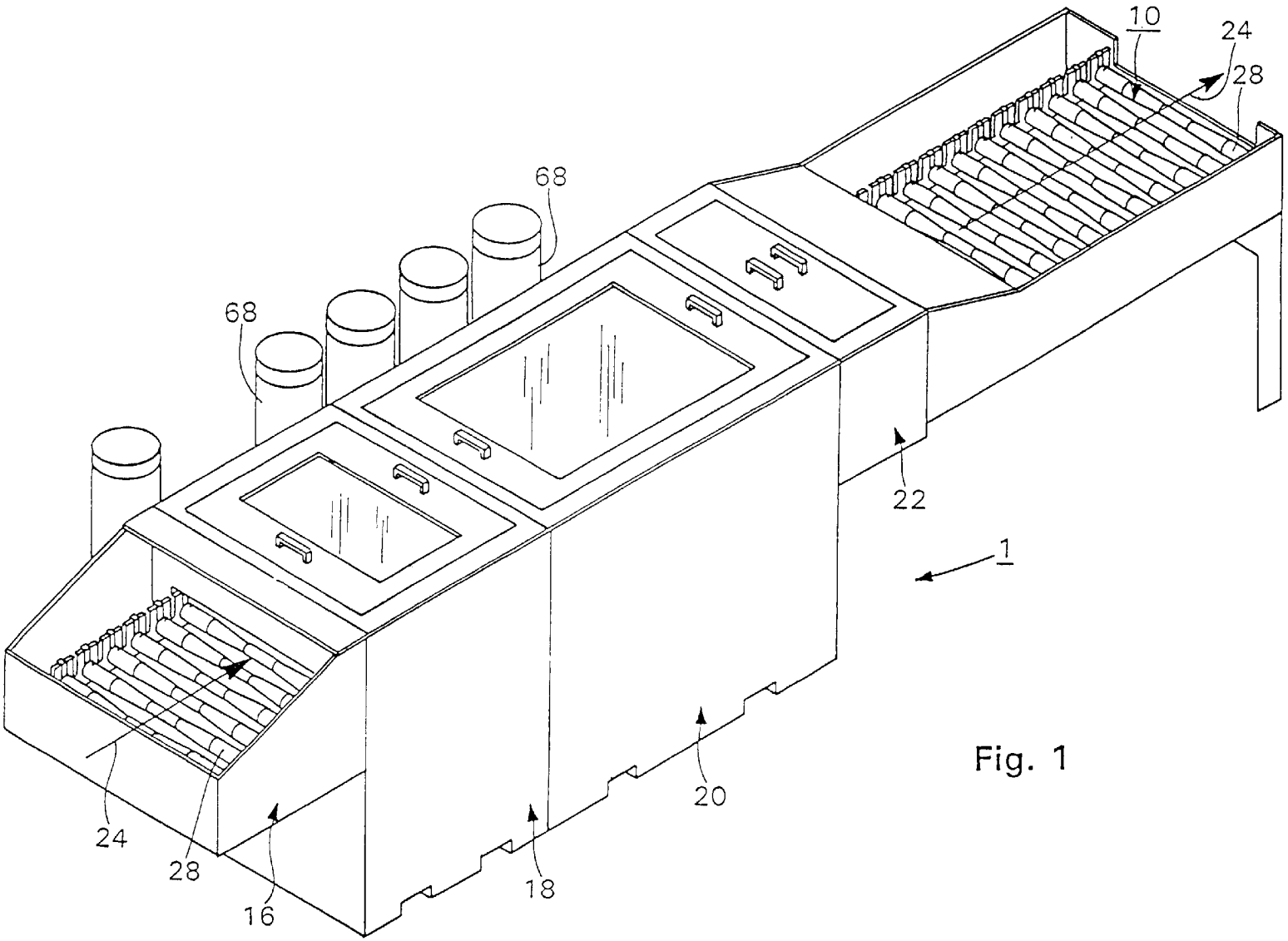
FIG. 1 is perspective view of an apparatus having features of the invention.

The following discussion describes in detail one embodiment of the invention and several variations of that embodiment. This discussion should not be construed, however, as limiting the invention to those particular embodiments. Practitioners skilled in the art will recognize numerous other embodiments as well. For a definition of the complete scope of the invention, the reader is directed to the appended claims.

The invention 1 is an apparatus and a method for using the apparatus for the fine cleaning of a thin substrate 2. The apparatus 1 comprises a transporter 10, one or more washing fluid ejectors 12 and one or more supporting fluid delivery ejectors 14.

A typical apparatus (machine) 1 of the invention is shown in FIG. 1. The machine comprises four modular sections: an input section 16, washing section 18, quadruple-cascade rinsing section 20, and drying/output section 22.

A transporter 10 conveys substrates 2 continuously along a transport path 24. A common longitudinal passageway for the substrate transport path 24 and a transporter drive shaft (not shown) communicates through all sections via passageway openings in the walls of the sections. Large portions of the input and output sections 16 and 22 are open so as to allow the machine operator to place substrates 2 onto and remove substrates 2 from the transporter 10 during operation. In the preferred embodiment, the input section 16 includes a 2" ventilation tube (not shown) mounted above the transport path 24 at the exit end of the input section 16.

Figure 2:
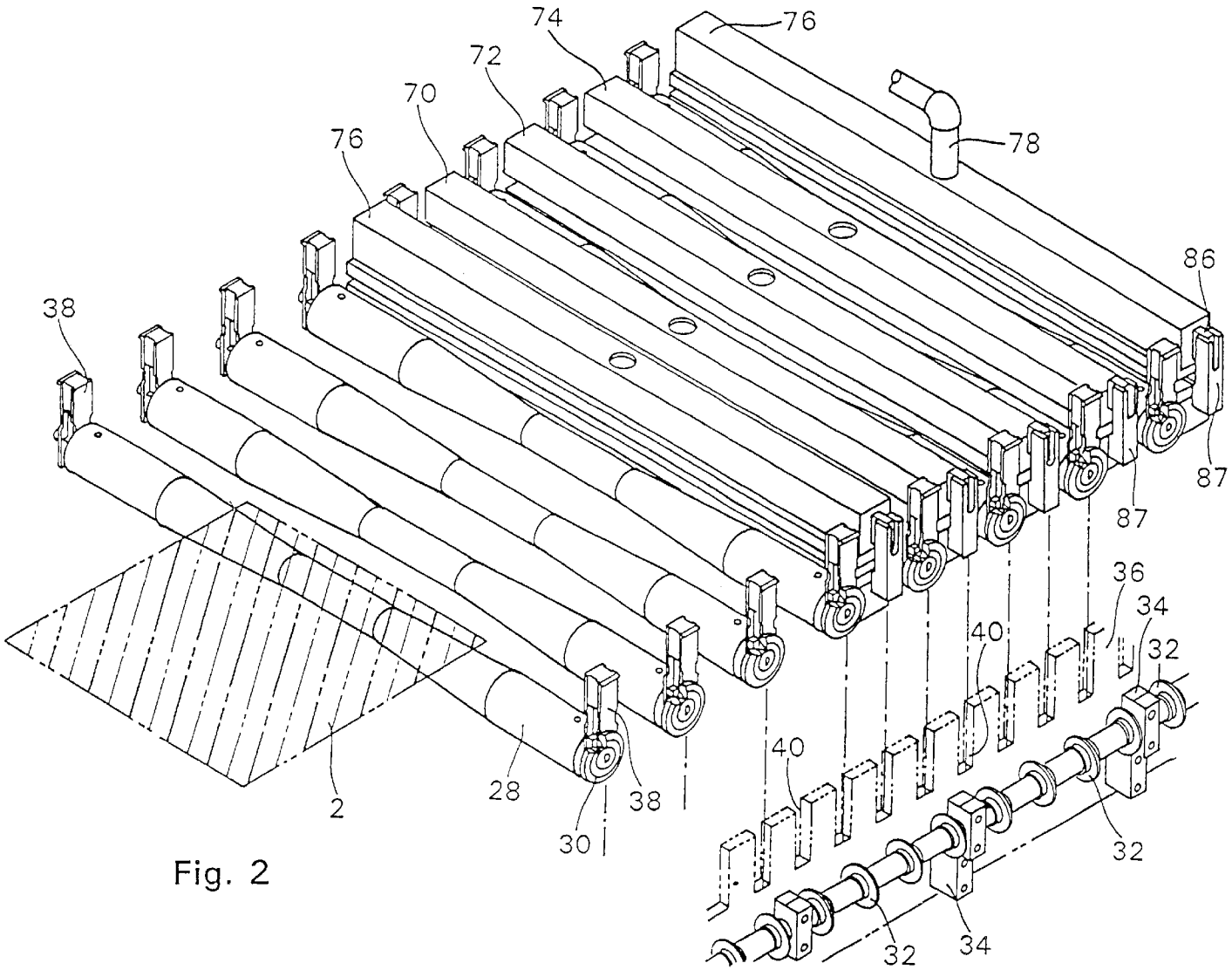
FIG. 2 is a detailed perspective view of centrally-tapered rollers useful in the invention.

A cross-sectional view of the transporter 10 is shown in FIG. 2. In a preferred embodiment, the transporter 10 comprises multiple centrally tapered, concave rollers 28 rotationally driven from the ends by beveled roller gears 30 which in turn integrate with drive shaft gears 32 spaced along the transporter drive shaft, which in turn is rotationally driven by a variable-speed drive motor (not shown).

The transporter drive shaft is supported by drive shaft bearing blocks 34 mounted to a first longitudinal transporter rail 36 mounted inside the aforementioned passageway parallel to and either side of the transport path 24.

The rollers 28 are supported by roller bearing blocks 38 placed in vertical slots 40 in both of the transporter rails. In a typical embodiment, the vertical slots 40 are about 0.75 inches wide and spaced apart on about 2 inch centers; the rails 36 are made from approximately ½ inch thick CPVC; and the bearing blocks 34 and 38 are molded polypropylene.

The drive shaft is comprised of multiple ⅜ inch hexagonal stainless steel shafts which are all about the same lengths as their corresponding machine sections. The shafts centrally penetrate hexagonal openings in beveled drive shaft gears 32 mounted along the drive shaft at substantially the same spacing as the vertical slots 40. The shafts are connected by couplers at the junctions of the machine sections for ease of disassembly of the machine and ease of replacement of drive shaft gears 32.

Figure 3:
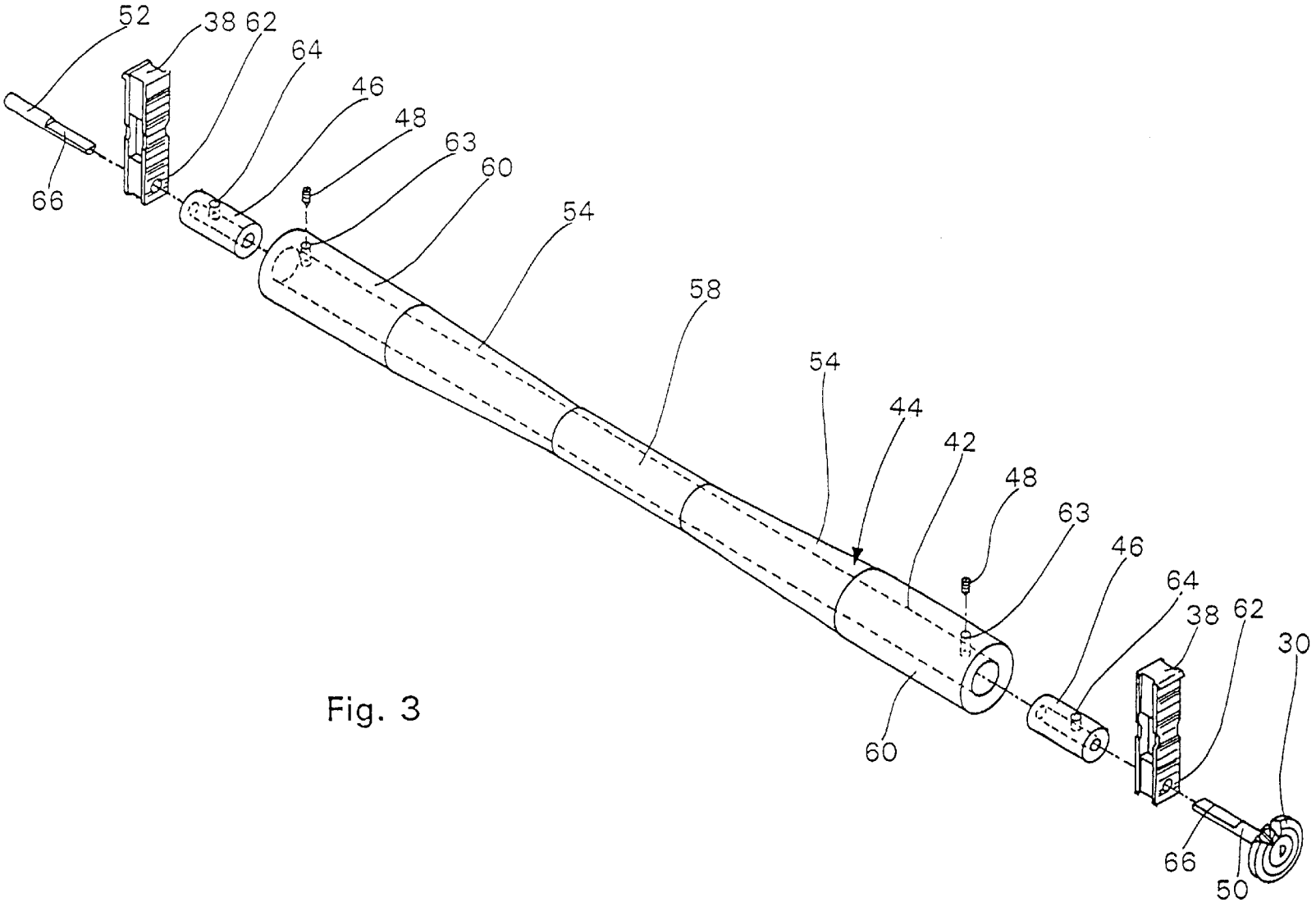
FIG. 3 is an exploded detail view of a centrally-tapered roller useful in the invention.

A perspective view of a transporter roller 28 is shown in FIG. 3. A preferred embodiment includes a hollow 1 inch diameter stainless-steel core 42 covered by a tapered EPDM sleeve 44, end plugs 46, set screws 48, driven and floating end shafts 50 and 52, and a beveled roller gear 30. The rollers 28 are centrally tapered so as to contact the substrate 2 only along the edges of the substrate 2. The tapering allows for varying widths of substrates 2 to be transported without having to make adjustments on the machine 1.

In a preferred embodiment, the roller taper is three degrees with respect to the horizontal, and the roller material for the transporter rollers 28 prior to the dryer is EPDM rubber with a hardness of 50 durometers, while the transporter rollers 28 after the dryer are solid black polypropylene with the same outer dimensions as the rubber rollers 28. The purpose of the rubber rollers 28 is to provide sufficient transporting traction for the glass in the wet sections, while the purpose of the black polypropylene rollers 28 is to minimize debris build-up, minimize substrate edge contact, and provide a dark background against which to inspect transparent substrates 2 as they are transported in the open portion of the output section 22. The combination of taper angle and rubber hardness for the EPDM rollers 28 insures that, in combination with the weight of the substrate 2 and the liquid it may carry and in combination with the net fluid forces on the substrate 2, serve to limit the amount of contact on the surface of the substrate 2 to two strips along the edges no wider than about 0.125 inches.

Inside and outside the tapered regions 54 are constant diameter regions, the length of the constant diameter central region 58 being set slightly below the minimum width of the substrate 2, and the length of the constant diameter outer regions 60 taking up the remainder of the transporter width.

In a typical embodiment, the constant diameter central region 58 is about 1.32 inches in diameter and extends over the central 4.75 inches of the roller, the tapered regions 54 extend outward about 5.625 inches from the central region 58 and the constant diameter outer regions 60 are about 1.9375 inches in diameter, extending outwards about 4.5625 inches. The total length of the roller without end-shafts and gears equals about 25.625 inches.

The drive shaft gears 32 rotationally engage roller gears 30 placed on the end of a ⅜ inch round stainless steel driven end shaft 50 which penetrates a clearance hole 62 in the roller bearing blocks 38 and rotationally drives the transporter rollers 28. The portion of the driven end shaft 50 which is in contact with the roller gear 30 is keyed for positive traction even in the presence of thermal expansion and liquids. Polypropylene end plugs 46, which are oversized by 0.02–0.04 inches and press-fit into the ends of the hollow stainless steel core 42 of the transporter roller 28, have two approximately ⅜ inch diameter by 2 inch long clearance holes 63 drilled into them parallel to the roller longitudinal axis. Two threaded holes 64 are placed substantially perpendicular to the roller longitudinal axis about ¾ inches from the ends of the roller 28 into which are screwed set screws 48.

The portion of the driven end shaft 50 which penetrates the transporter roller 28 has a flat portion 66 machined into it against which the set screw 48 is turned, preventing relative slippage between the end shaft 50 while allowing for removal of the driven and floating end shafts 50 and 52 for replacement of the end shafts 52 and 52 and/or roller gear 30.

The floating end shafts 52 are supported by a clearance hole 62 in the roller bearing blocks 38 placed in the slots 40 in a second transporter rail (not shown) and allowed to rotate freely.

Guides (not shown), either in the form of conical wheels which may be attached to or rotate with the transporter rollers 28, or wedged-shaped guides mounted between rollers 28, may be used at intervals along the transport path 24 to ensure that the substrates 2 stay within the tapered regions 54 of the transporter rollers 28 as they travel along the transport path 24.

The substrate 2 is conveyed by the transporter 10 at speeds of from about 10 to about 325 inches/min.

For a vertical arrangement, the transporter 10 could employ rollers along the bottom to convey the substrates 2 by a side edge.

As an alternative to the centrally-tapered rollers 28, a conveyor belt (not shown) with cut-out sections for substrate placement or two belts can be used in the transporter 10. Also, disks or wheels (not shown) which are moveable along shafts could be used in place of the tapered rollers. Unlike in the use of tapered rollers 28, each of these alternative arrangements would require adjustment for differing widths of substrates 2.

Above and below the transport path 24 are placed pairs of ejector manifolds for delivering various liquid and gaseous fluids to the substrate surfaces. Liquid leaving the ejector manifolds strikes the substrates 2 as they travel along the transport path 24 and is collected by gravity into a sump contained within each liquid machine section. A pump draws the liquid from the sump and circulates it first to a ball-check valve, then through a filter chamber 68 containing filter elements, through adjustable valves, and finally to the ejector manifolds which are positioned above and below the substrate transport path 24. The purpose of the ball-check valves is to keep the filter chambers 68 from partially draining liquid during pump shut-down, since the filter chambers 68 are partially above the liquid levels in the sumps and would otherwise drain somewhat and partially fill with air, which could impair the efficient operation of the filters and/or impair the safe operation of the system. In a typical embodiment, the plumbing material, ball check valve and filter chamber 68 materials are all CPVC. Each filter chamber 68 contains five 30-inch pleated polypropylene filter elements with a rating of 1 micron nominal. Pressure gauges, communicating with the plumbing via semi-flexible polyethylene tubing, monitor the operating pressure of the fluids being delivered to the ejector manifolds, which can be adjusted by turning the valves. A typical embodiment uses gauges with all stainless steel construction are used.

In the sections where liquids are used, anti-dragout ejector manifolds (described below) are used to limit the amount of liquid that mixes between sections.

The washing, rinsing, and drying sections 18, 20 and 22 are mostly enclosed and vented with vent pipes (not shown) near the passageway opening of the input and output sections 16 and 22 to control the amount of moisture and/or chemicals escaping from the machine into the immediate area. Washing, rinsing and drying fluids are delivered to the substrate 2 via ejector manifolds in the various sections.

The washing section 18 includes three washing ejector manifolds 69. A first medium pressure washing ejector manifold pair 70 is followed by a high-pressure washing ejector manifold pair 72 and then by a second medium-pressure washing ejector manifold pair 74.

In a typical embodiment, washing fluid circulation is supplied by a five-horsepower centrifugal pump to an anti-dragout manifold 76 and to the medium-pressure ejector manifolds 70 and 74 via the above-mentioned check valve and filter chambers 36.

The high-pressure manifold pair 72 is supplied by a 16-stage, 1.5 horsepower pump, for which coarse filtration (y-strainer) only is provided on the inlet side of the pump.

Since the washing manifolds 69 are easily removed and exchanged, differing combinations of pressure and positions are possible, while keeping the anti-dragout manifolds 76 at the entrance and exit ends of the section.

Washing liquid is supplied to the washing ejector manifolds 70–74 via input conduit 78 at 10–50 psi for the medium-pressure manifolds 70 and 74 and 50–160 psi for the high-pressure manifolds 72. Such operating pressures provide extremely fast-moving jets (velocities up to about 36 meters/second) for efficient particulate removal from the substrate surface.

The washing ejector manifolds 69 are constructed of 1.5 inch diameter square stainless steel tubing with a wall thickness of 0.170 inches, and may alternatively be formed from other suitable materials able to withstand the desired pressures without substantially departing from the intent of the invention.

The upper and lower ejectors 12 of the washing manifolds 69 are positioned substantially opposite each other, so as not to impose any extreme torque on the substrate 2 in either the longitudinal or transverse directions.

In operation of the washing section 18, where the substrate 2 is conveyed along the transport path 24 in a horizontal orientation, the substrates 2 may bend downwards slightly due to the weight of washing liquid accumulating on the substrate 2 upper surface, and/or by the net forces of the ejector jets 12. Preferably, the upper surface of the lower washing manifolds 69 are at a height equal to or slightly higher than the upper nip of the central constant diameter section of the nearby transporter rollers 28. As a result, any curvature in the substrate 2 which would otherwise bring the central portions of the substrate 2 in close proximity to the central constant diameter 58 region of the transporter roller 28 brings it first in close enough proximity to the upper surface of the lower washing ejector manifold 69, which surface in combination with the ejector jets 12 provide a fluid bearing force sufficient to balance the net bending forces on the substrate 2 and prevent the central substrate section from contacting non-fluid materials.

Figures 6A, 6B, 6C, 6D:
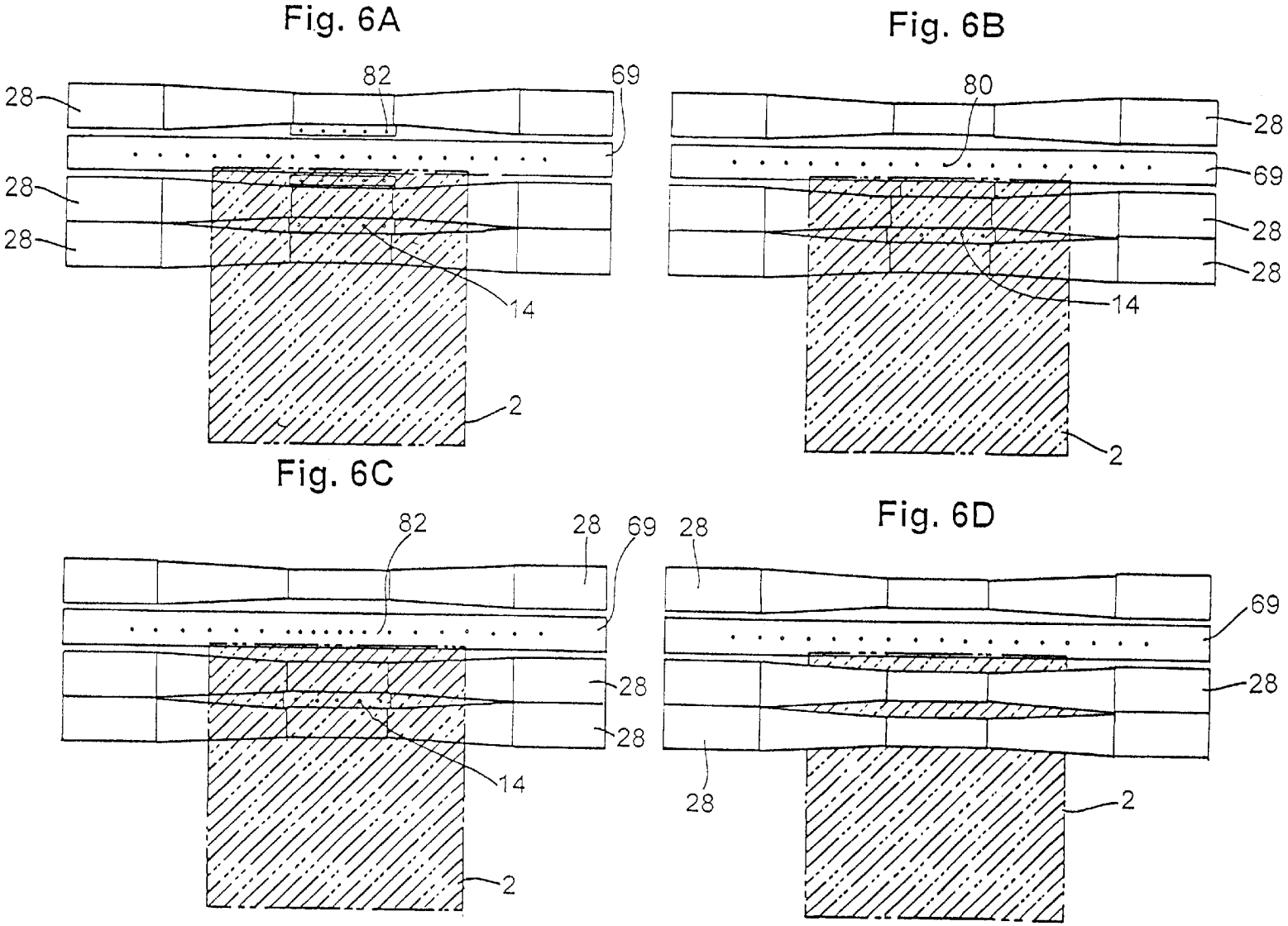
FIG. 6A is a plan view of a washing manifold section useful in the invention.
FIG. 6B is an alternative plan view of a washing manifold section useful in the invention.
FIG. 6C is a second alternative plan view of a washing manifold section useful in the invention.
FIG. 6D is a bottom view of a washing manifold section useful in the invention.

As an alternative to fluid bearing support, the fluid jet ejectors impinging upon the lower central substrate surface could eject from a starting height lower than the central constant diameter region of the transporter roller, but would provide a preferentially central upwards impinging force upon the lower substrate central surface, which upwards impinging force would serve to keep the otherwise bending substrate 2 in a substantially planar configuration. As shown in FIG. 6A and 6D, this preferentially central upward impinging force can either be provided by constructing larger ejector openings 80 in the lower central washing ejectors 69 (as shown in FIG. 6B) by providing higher pressure to the lower central ejectors either by the use of flow restrictions placed inside the ejector manifold in the regions near the transport path of the substrate edges, or by the use of a second supply line, or by the use of additional supporting ejectors 82 placed either within the washing manifolds 69 (as shown in FIG. 6C) or in a second supporting ejector manifold 76 adjacent to the washing ejector manifolds 69 (as shown in FIG. 6A). Alternatively or additionally, washing ejections 69 in the upper washing manifolds may provide preferentially central impinging force on the substrate surface. In this way, both sufficient contact on the substrate edges for traction and sufficient central substrate surface support for liquid only contact may be maintained (as shown in FIG. 6D).

If separated from communication with the washing ejectors 12, the supporting ejectors 14 could also be supplied with a separable liquid or gas to provide preferential support for the central section of the substrate. By the term "separable liquid" it is meant any liquid which can be conveniently separated from the washing (or rinsing) fluid (e.g. mineral oil).

Since non-fluid contact with the substrate 2 is only applied by the tapered rollers 28 upstream and downstream of the washing ejector manifolds 70 and 74, both entire upper and lower surfaces of the substrate 2, as well as to a less direct extent all edges of the substrate 2, are exposed completely to the washing fluid ejected from the washing ejector manifolds 69.

Figures 4A, 4B:
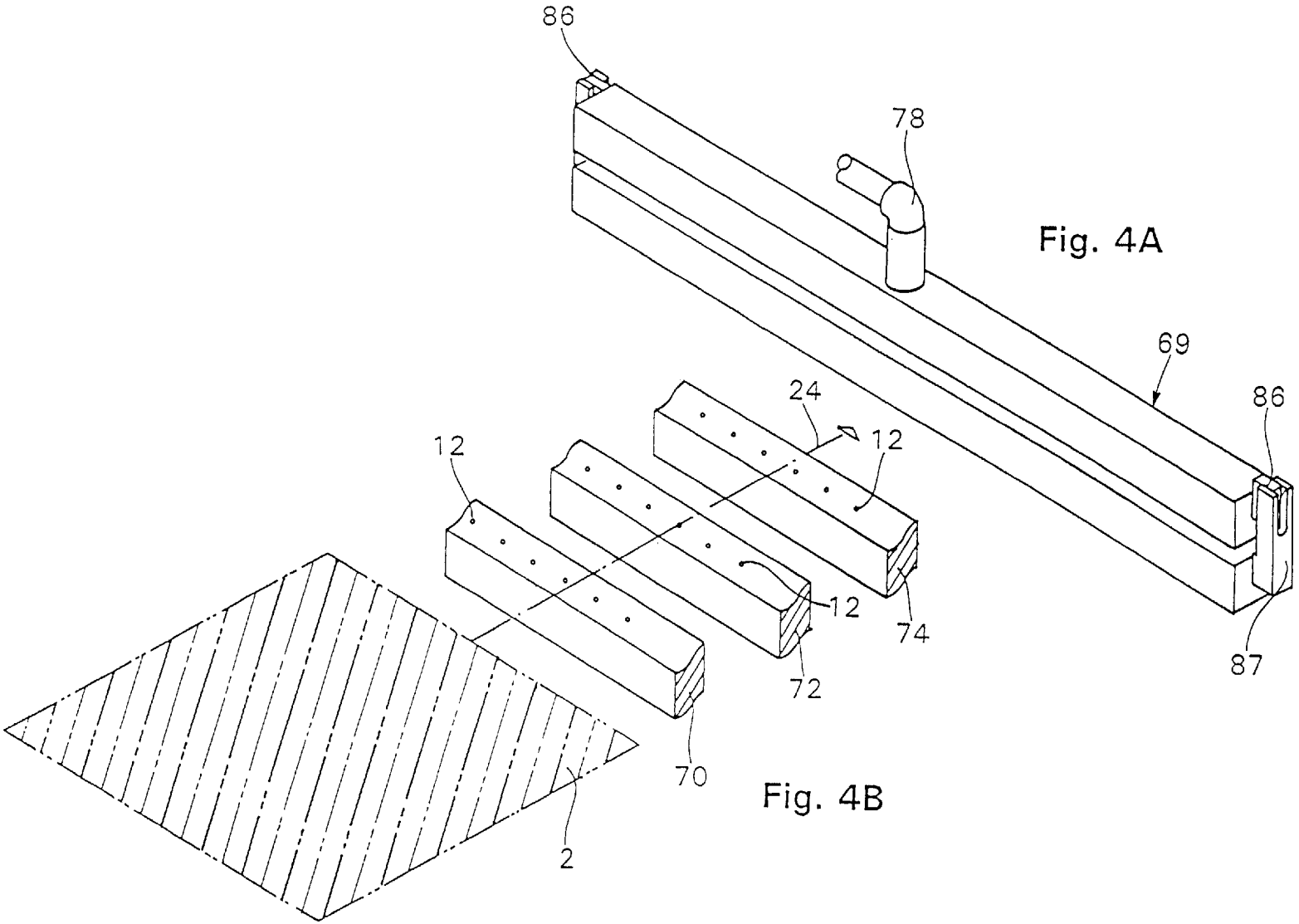
FIG. 4A is a detailed view of a washing ejector manifold useful in the invention.
FIG. 4B is a detail of the ejector configuration of a lower washing ejector manifold.
Figure 5:
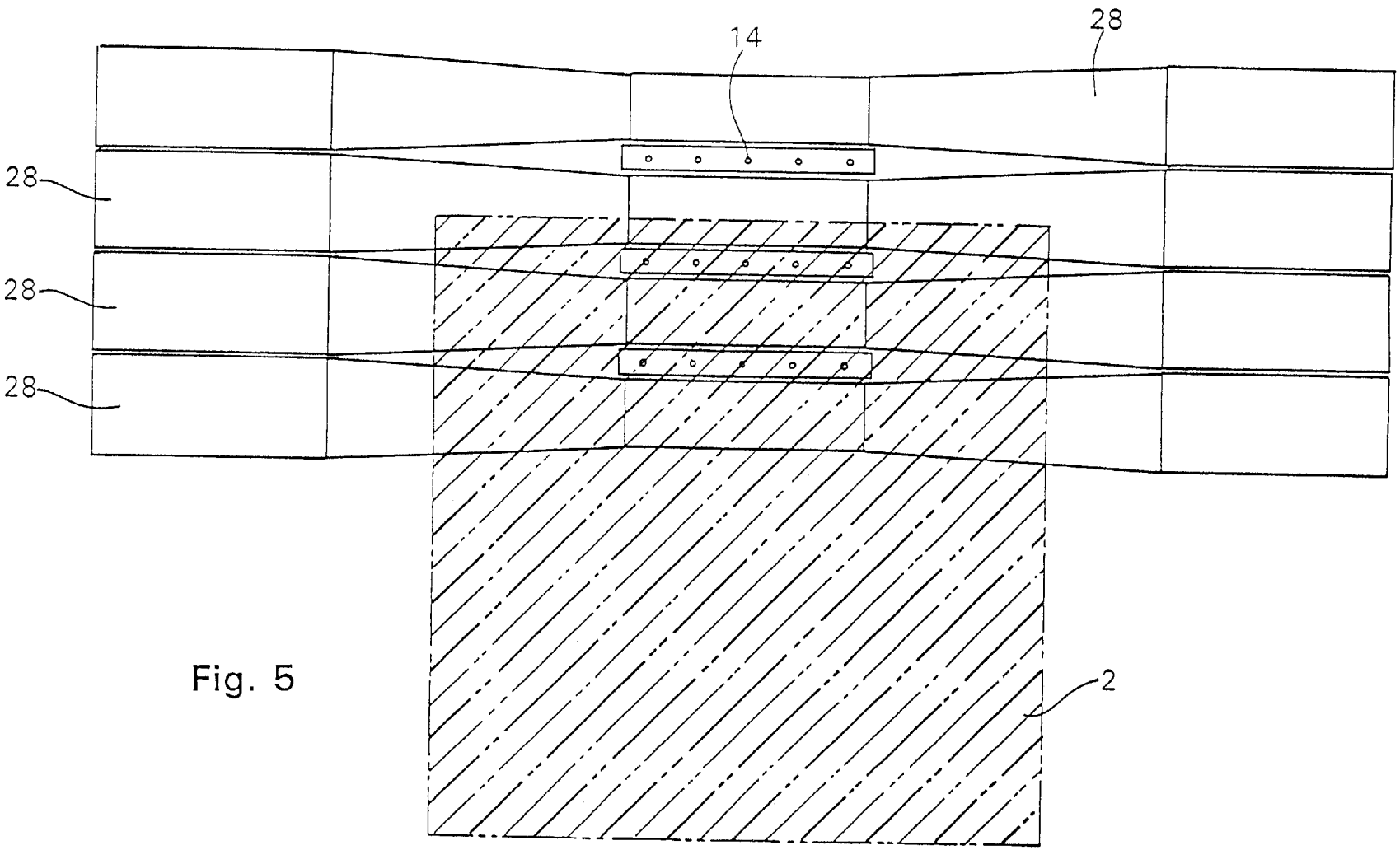
FIG. 5 is a plan view of several banks of support fluid ejectors useful in the invention.

A perspective view of a pair of washing ejector manifolds 69 is shown in FIG. 4. Plumbing carrying liquid circulating from the pump via the check valve, filter, and flow-control valves is provided to central inlets in the washing ejector manifolds 69, which are mounted to upper and lower manifold bearing blocks 86 which slide into the slots 40 in the transporter rails 36 and 66.

The plumbing inside the washing section 18 is detachable from the inside wall. As shown, the upper manifold bearing block 86 slides into a manifold bearing block slot 88 in the lower manifold bearing block 86. Stainless steel ¼–20 by ½ inch set screws are placed in the upper surfaces of the bottoms of the transporter rail slots 40 and manifold bearing block slots 88, upon which set screws rest the lower and upper manifold bearing blocks 86, respectively. By adjusting the set screw height, the vertical position of each washing ejector manifold 69 can be varied. The distance between substrate 2 traveling along the transport path 24 and the ejectors is preferably between about 0.002 inches and 0.300 inches.

The ejector holes located in the top and bottom surfaces of the lower and upper washing manifolds 69, respectively, direct fluid across said working distance against the surfaces of the substrate 2 as it travels along the transport path 24 between the manifolds. In the preferred embodiment, the washing fluid exits from the ejectors 12 in the form of jets, each exerting a force on the surface of the substrate 2. The ejectors 12 in the three washing manifolds 70–74 are staggered with respect to the transport path 24 to assure coverage of the entire substrate surface.

In a typical embodiment, 19 ejectors 12 having a diameter D of 0.046 inches are spaced along the axis (transversely to the substrate transport path 24) of the washing ejector manifolds 69 at a center-to-center spacing S of about 1.2 inches, giving a ratio of S/D of about 26. Ratios of S/D of less than about 4 are undesirable due to the increasingly large flow rate required to maintain desired pressures of the washing ejectors, and conversely ratios of S/D greater than about 100 are undesirable because the efficiency of the ejector jets 12 in cleaning the surface begins to fall off.

Figure 9:
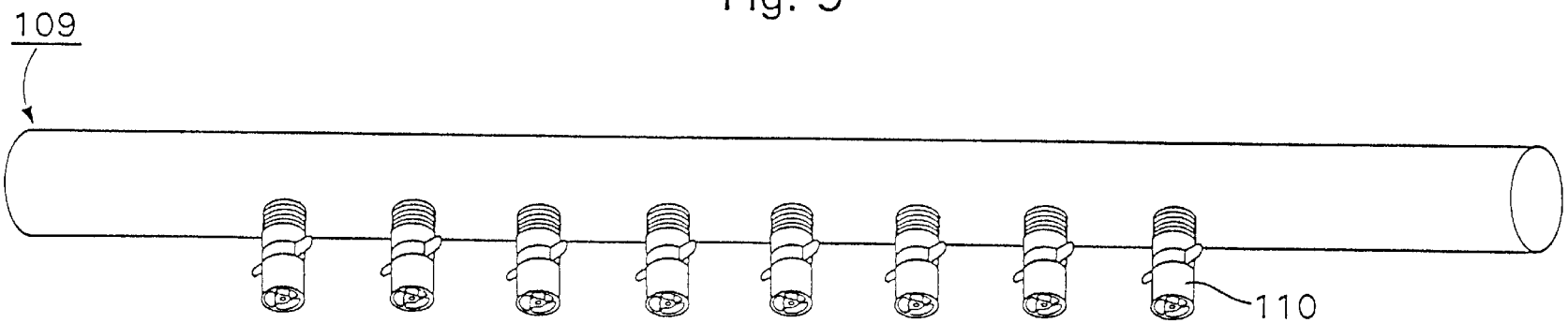
FIG. 9 is a side view of an alternative washing manifold using spray nozzles useful in the invention.

FIG. 9 shows an alternative spray washing manifold 109 that can be used in place of an ejector washing manifold. Cone nozzles 110 are shown, but fan nozzles may be used as well. Pressure ranges for spray nozzles would be similar as those mentioned previously for washing ejectors 12. In the case where anti-dragout manifolds 76 are used in close proximity to spray manifolds, a box-shaped splash cover (not shown) is required so as not to unduly spray washing fluid beyond the anti-dragout manifolds 76 and defeat their purpose.

Similar sections for chemical processing (such as surface treatment, etching, photoresist developing, photoresist stripping, or the like) could be constructed from materials compatible with the process chemistry and used in place of, or in addition to, the wash section.

The rinsing section 20 constitutes a four-stage countercurrent cascade rinse. Each rinsing stage of the rinsing section 20 contains one pair each of forward- and backward-facing anti-dragout manifold pairs 84 fed by a one horsepower centrifugal pump and filtered with the same check valve/filter combination as mentioned above. The fluid level in each sequential stage is controlled by means of holes in divider walls which become progressively higher. In operation of the rinsing section 20, as fresh rinse water is fed continuously either to the last rinse stage's rinsing devices or to the last stage's sump, "used" water continuously overflows from rinsing stages two, three and four to stages one, two and three, respectively. This arrangement is well-known in the conveyorized wet processing industry.

Heating is provided in both the 1st and 4th rinse stages for heating the sumps up to 200 degrees Fahrenheit.

Forward-facing and backward-facing anti-dragout ejector manifold pairs 84 placed at the entrance and exit of each liquid chamber are used to minimize the amount of liquid exchanged between sections.

As mentioned for the washing section 18, forces on the substrate 2 maintained entirely by fluid contact on all but the edges of the substrate 2.

Figures 7A, 7B:
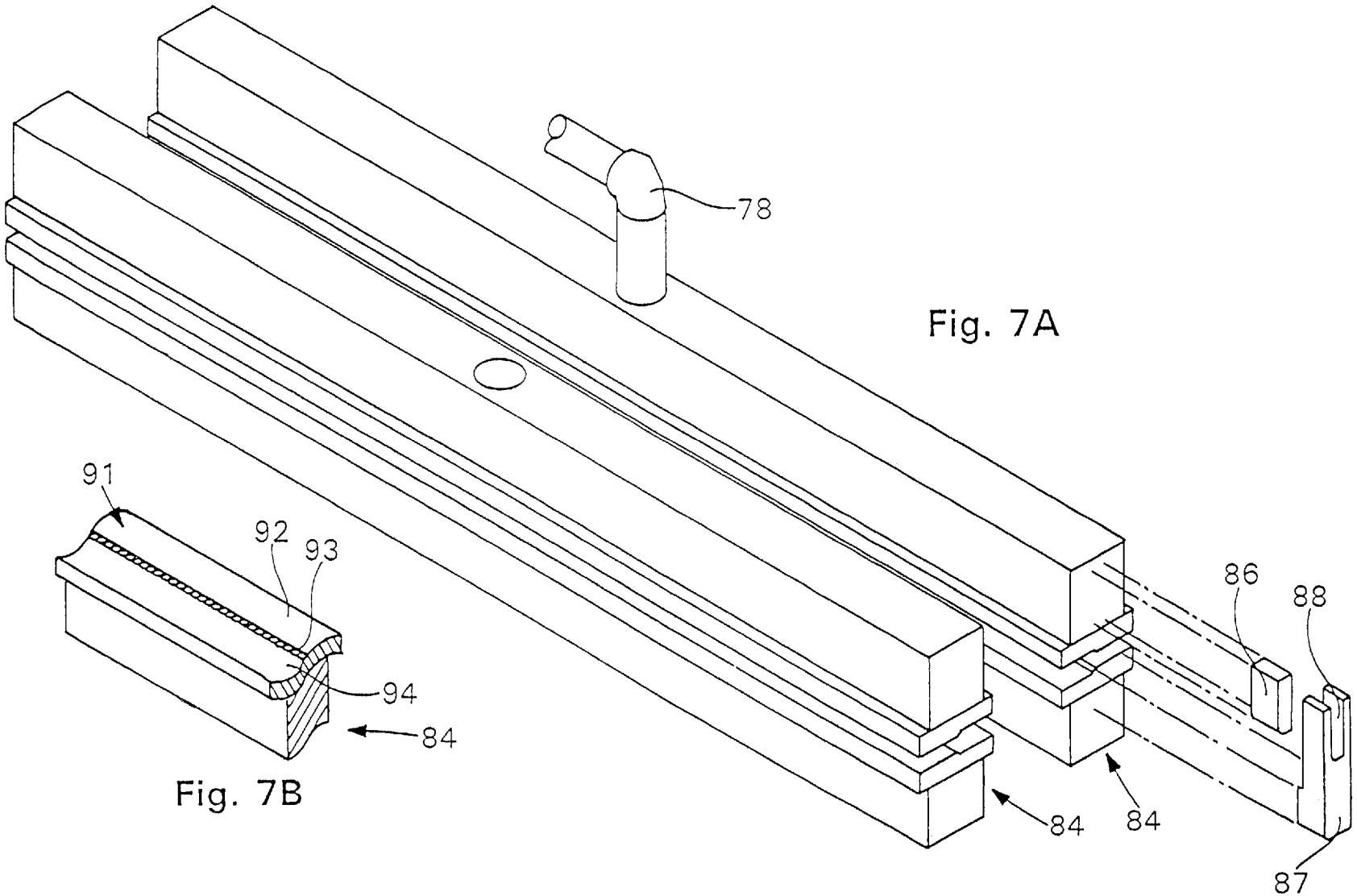
FIG. 7A is a perspective view of a pair of anti-dragout ejector manifolds useful in the invention.
FIG. 7B is a detailed view of the ejector configuration useful in the anti-dragout ejector manifolds shown in FIG. 7A.

FIG. 7 shows a forward-facing and backward facing anti-dragout ejector manifold pairs 84 in the rinsing section 20. Manifold bearing blocks 86 with height adjustment capability, pump with valves, filter and detachable plumbing are arranged similarly to that explained for the washing ejector manifolds 70 and 74 above. The pumps in this case are one-horsepower centrifugal pumps.

Figure 10:
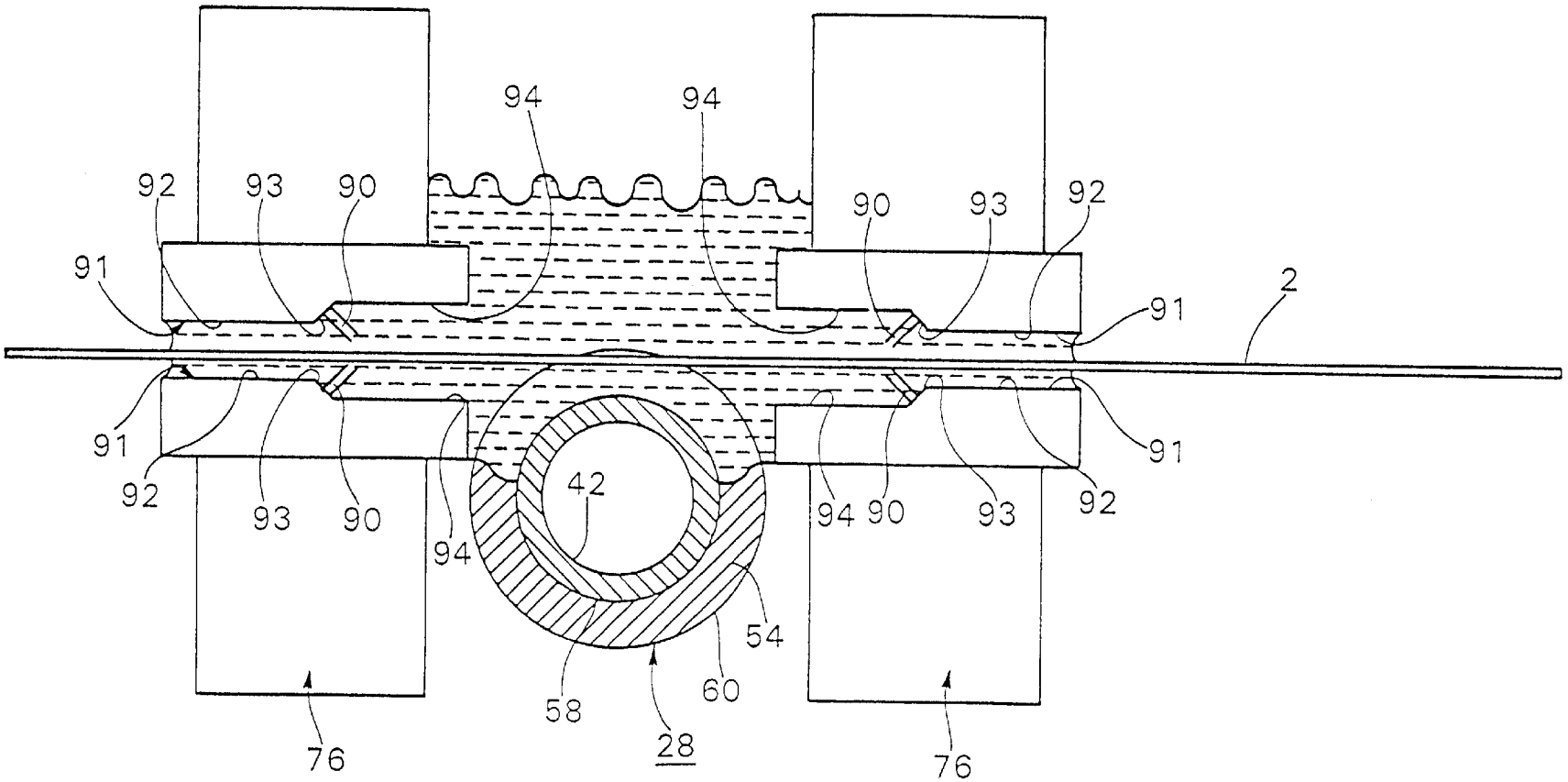
FIG. 10 is a cross-sectional side view of a pair of anti-dragout ejector manifolds useful in the invention.

Unlike the medium- and high-pressure washing manifolds 70–74, the purpose of the anti-dragout manifolds 76 is not so much high velocity fluid delivery as it is fluid entrainment. This is achieved by placing the ejector jets 90 at a relatively closer spacing S and inclining them at an angle THETA with respect to the transport path. The anti-dragout devices comprise a non-flat surface 91 shown in FIG. 10, both above and below the transport path 24. The non-flat surface 91 has a first section 92 disposed substantially parallel with the transport path 24, a second section 93 disposed substantially non-parallel with respect to the transport path 24, and a third section 94 disposed substantially parallel with the transport path 24. The first section 92 is disposed between about 0.005 and about 0.25 inches from a substrate 2 being transported along the transport path 24. The third section 94 is disposed between about 0.01 and about 0.6 inches from a substrate 2 being transported along the transport path 24. In a preferred embodiment, the first section 92 is disposed between about 0.04 and about 0.12 inches from a substrate 2 being transported along the transport path 24. The inclination THETA of ejector jets 90 helps both to push liquid in towards the third section 94 and also to pull liquid from and prevent the free flowing of liquid beyond the first section 92 of the anti-dragout manifolds 76. Such entrainment has been seen to be maximized by disposing the inclined ejectors 90 centrally along the second section 93 of the non-flat surface 91.

Within this range of distances, surface tension of the liquid also aids in entrainment at the third section 94. Above this range, fluid begins to escape from the third section 94 across the substrate surface. With the embodiment disclosed, liquid is substantially retained between the ejector manifold pairs 84 as the substrates 2 pass between them in a liquid-contact-only manner.

In a preferred embodiment, the first section 92 of the non-flat surfaces 91 are about one inch wide and is ⅛ inch closer to the substrate surface than the third section 94 which is also about 1 inch wide. The ejectors 90 are inclined at an angle THETA of between about 10° and about 80°, preferably about 45°, and have a diameter D of 0.063 inches and are spaced at a center-to-center spacing of 0.25 inches, giving an S/D ratio of about 4 and are about 0.02 inches further from the substrate than the first section 92 is from the substrate 2.

Means for substrate central region support within the anti-dragout manifolds 76 can be provided similarly to those explained above for washing manifolds 69.

The dryer/output section 22 has an air ejector manifold pair 96 which is fed by a remotely located turbine blower with a 1-micron HEPA filtration box on its pressure side. The output section 22 is designed to extend through and beyond a three-foot thick cleanroom wall and has an open transport length of about 24 inches.

Figures 8A, 8B:
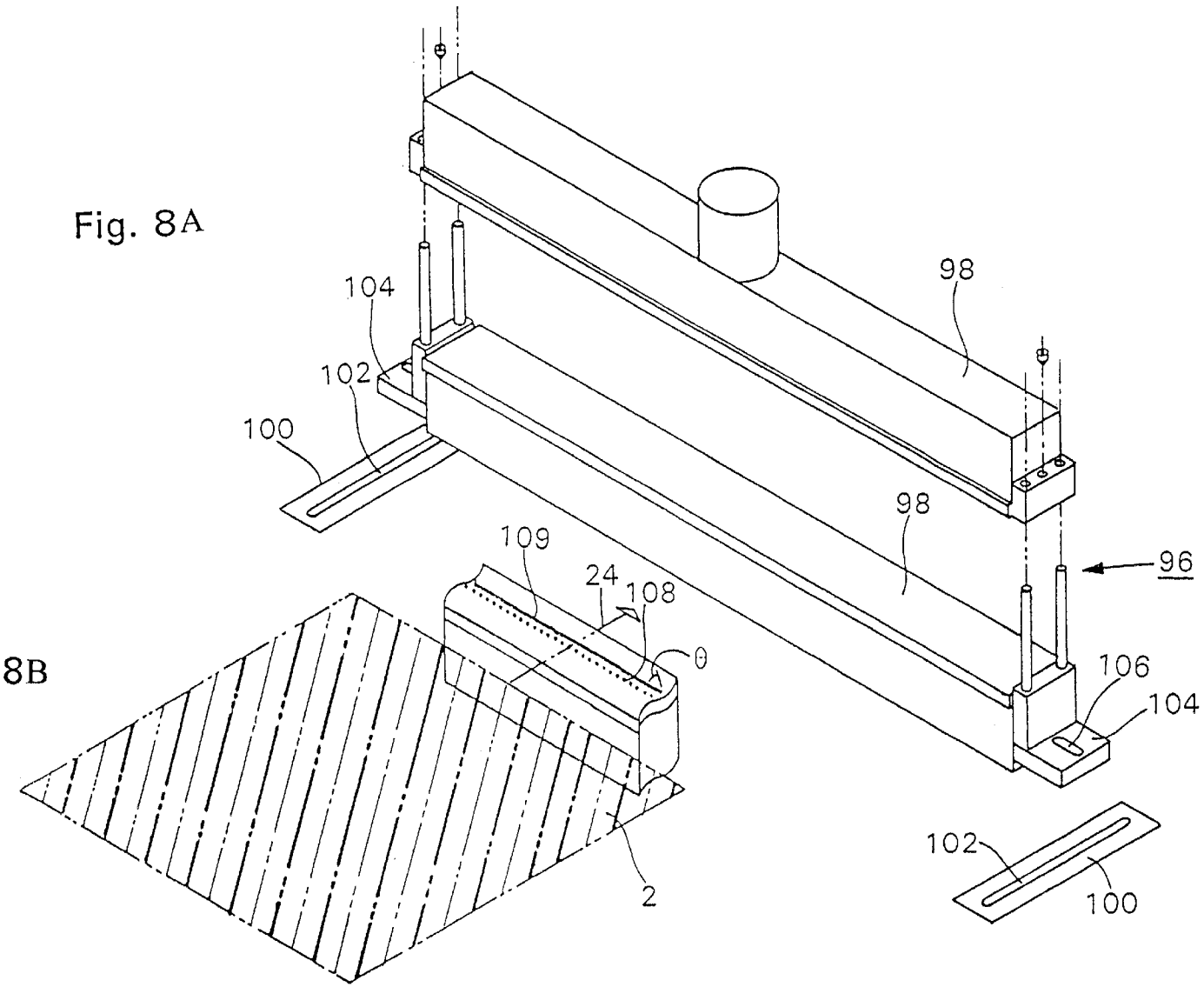
FIG. 8A is an exploded view of a drying ejector manifold useful in the invention.
FIG. 8B is a detailed view of drying ejector hole patterns useful in the drying ejector manifolds shown in FIG. 8A.

FIG. 8 shows the drying ejector manifold 98 portrayed in operation. Sliding horizontal track rails 100 are mounted to the vertically upstanding transporter rails 36 and 66. The track rails 100 contain adjusting slots 102 (parallel to the transport path 24). The lower drying ejector manifolds are 98 mounted on L-shaped brackets 104 which have a clearance slot 106 (parallel to the axis of the drying ejector manifold 98 and approximately perpendicular to the transport path 24) in the base for a fastening bolt. By sliding the ends of the lower drying manifold 98 to their desired positions and securing the fastening bolts, the dryer ejector manifold 98 can be positioned at various horizontal distances from and at various angles relative to transporter rollers 28 on either side. At the extremes of positions, a drying manifold pair 96 can be parallel to and substantially adjacent to the transport rollers 28 on either side (taking up the equivalent transport length of a single roller 28), or it can be set at an angle of about 19 degrees (taking up the equivalent transport length of three rollers 28).

A typical problem mentioned above occurs when the angle of the dryer manifold is 0. That is, as the trailing edge of the substrate 2 passes between the dryer manifolds 98, surface tension effects tend to build up a relatively thick layer of liquid around the trailing edge of the substrate 2, and the layer is so thick as to cause unwanted splattering of the liquid, droplets of which re-attach themselves to the substrate surface and evaporate, leaving unwanted stains. To combat this phenomenon, a relatively sparse first row of drying ejectors 108 is placed prior to a relatively dense second row of drying ejectors 109 (See FIG. 8A). The sparser first row 108 effectively removes most of the surface water, leaving a more concentrated row of jets to deal with the trailing edge effect. Additionally, by angling the drying manifold 98, the time at which the trailing edge passes under drying ejectors 108 and 109 is no longer simultaneous along the trailing edge of the substrate 2. The liquid is swept at a slightly transverse angle, allowing the tenacious last drops of liquid to be gently nudged to one corner of the substrate 2 before having to totally overcome the surface tension of liquid around the edge.

In a preferred embodiment, the dryer ejectors 108 and 109 are inclined at an angle THETA of 85 degrees. The dryer ejectors 108 and 109 have a diameter of about 0.063 inches and are spaced at a spacing of about 0.25 inches in the sparse row and about 0.125 inches in the denser row. The drying manifold 98 is rotated at an angle of about 9 degrees and the filtered air is delivered at a pressure of about 2 psi. Working surfaces of the upper and lower manifolds 98 are set at a distance of about 0.25 inches from the substrate surfaces.

The primary materials of construction for the four sections are polypropylene, chloro-polyvinyl chloride (CPVC), CPVC and polypropylene, respectively. Other materials, such as stainless steel, would be suitable as well. A preferred embodiment uses materials that have low particulate-creating potential as is common for critical cleanroom applications, or materials that are coated appropriately.

The sections are mounted together with stainless steel mounting bolts. The liquid-containing sections are sealed to adjoining sections with 3/16 inch diameter tygon tubing and silicone glue placed in 1/16 inch deep grooves cut into the contacting surfaces of adjacent modular sections around the perimeter of the passageway openings.

Having thus described the invention, it should be apparent that numerous structural modifications and adaptations may be resorted to without departing from the scope and fair meaning of the instant invention as set forth hereinabove and as described hereinbelow by the claims.

What is claimed is:

1. An apparatus useful in the cleaning of a substrate having a substrate top side, a substrate bottom side, a substrate central section and substrate edges, the apparatus comprising:

(a) a transporter having one or more edge contactors which move the substrate along a transport path at a uniform transport velocity by non-fluid contact with the substrate bottom side at the edges of the substrate alone; and (b) one or more supporting fluid delivery ejectors, the fluid delivery ejectors being configured to deliver a greater flow of a supporting fluid to the center of the substrate than to the periphery of the substrate transported along the transport path such that the substrate central section is maintained in a substantially planar configuration by the supporting fluid along the transport path.

2. The apparatus of claim 1 wherein the supporting fluid delivery ejectors each include an ejector opening, and the ejector openings for the supporting fluid delivery ejectors located under an area where the substrate central section is adapted to pass have a larger diameter than the supporting fluid delivery ejectors which are in proximity to where a remaining portion of the substrate is adapted to pass.

3. The apparatus of claim 1 wherein the supporting fluid delivery ejectors located along the transport path under an area where the substrate central section is adapted to pass are connected to a higher pressure source of supporting fluid.

4. The apparatus of claim 1 wherein additional supporting fluid delivery ejectors are located along the transport path under an area where the substrate central section is adapted to pass.

5. The apparatus of claim 1 wherein one or more washing fluid ejectors are located along the transport path to deliver washing fluid to the substrate.

6. The apparatus of claim 5 wherein washing fluid is used as the supporting fluid which is delivered to the supporting fluid delivery ejectors.

* * * * *